United States Patent [19]

Muramatsu et al.

[11] Patent Number: 4,457,282

[45] Date of Patent: Jul. 3, 1984

[54] ELECTRONIC CONTROL FOR FUEL INJECTION

[75] Inventors: Toshihiko Muramatsu; Akio Kobayashi, both of Kariya, Tomomi Eino, Toyota, Toshio Kondo, Kariya, all of Japan

[73] Assignee: Nippondenso Co., Ltd., Kariya, Japan

[21] Appl. No.: 390,963

[22] Filed: Jun. 22, 1982

[30] Foreign Application Priority Data

Jun. 24, 1981 [JP] Japan ..... 56-97724

[51] Int. Cl.[3] ..... F02D 5/02

[52] U.S. Cl. ..... 123/486; 123/480; 123/492

[58] Field of Search ..... 123/478, 480, 486, 492

[56] References Cited

U.S. PATENT DOCUMENTS

| | | | |
|---|---|---|---|
| 3,969,614 | 7/1976 | Moyer et al. | 123/480 |
| 4,249,498 | 2/1981 | Drews et al. | 123/478 |
| 4,335,695 | 6/1982 | Phipps | 123/478 |
| 4,359,991 | 11/1982 | Stumpp et al. | 123/486 |

*Primary Examiner*—Andrew M. Dolinar

*Attorney, Agent, or Firm*—Cushman, Darby & Cushman

[57] ABSTRACT

An electronic control system for fuel injection into an engine controls an air-fuel ratio at a desired air-fuel ratio during a high load operation of the engine. The electronic control system performs the operations of detecting operating parameters of the engine, computing by a computing unit a time width in accordance with the detected operating parameters, selecting a maximum time width value of the injection pulse from a preliminarily stored table of maximum time width values thereof in accordance with the value of at least one of the detected operating parameters, comparing the computed time width value with the selected maximum time width value, limiting the computed time width value in accordance with the selected maximum time width value, and applying the injection pulse to the fuel injectors, thereby controlling the air-fuel ratio under the high load conditions at a desired air-fuel ratio and also preventing the malfunction of continuous fuel supply from occurring in the fuel injectors.

11 Claims, 10 Drawing Figures tpmax (msec)

| | | | | | | | | | | |
|---|---|---|---|---|---|---|---|---|---|---|
| 3.52 | 3.56 | 3.67 | 3.78 | 3.74 | 3.75 | 3.82 | 3.86 | 3.85 | 3.74 | 3.58 |

8 12 14 20 24 28 32 36 40 44 x10²

ENGINE SPEED N (rpm)

tpmax (msec)

| THROTTLE OPENING (FULLY OPEN) | | | | | | | | | | | |
|---|---|---|---|---|---|---|---|---|---|---|---|
| 10 | 3.52 | 3.56 | 3.67 | 3.78 | 3.74 | 3.75 | 3.82 | 3.86 | 3.85 | 3.74 | 3.58 |
| 9 | 3.50 | 3.54 | 3.65 | 3.76 | 3.72 | 3.73 | 3.80 | 3.84 | 3.83 | 3.72 | 3.56 |

0 8 12 14 20 24 28 32 36 40 44 x10²

ENGINE SPEED N (rpm)

ELECTRONIC CONTROL FOR FUEL INJECTION

FIELD OF THE INVENTION

The present invention relates to a method and apparatus for electronic control of fuel injection in which the basic fuel injection quantity from each fuel injection valve of an internal combustion engine under a high load condition is controlled to control the air-fuel ratio (A/F).

DESCRIPTION OF THE PRIOR ART

In known electronically controlled fuel injection systems of the type which controls the opening time length of electromagnetic fuel injection valves for intermittently supplying fuel to an engine, for example, an electronically controlled fuel injection system of the mass flow type, the opening time length T of each electromagnetic fuel injection valve is computed from an equation $T=t_p \times k_1$. Here, $t_p$ represents a basic fuel injection quantity (the time width of a pulse for energizing the solenoid of an electromagnetic valve), and it is determined by the division of an engine intake air quantity Q by an engine speed N. $K_1$ represents a correction factor determined by outputs of various sensors, for example, a water temperature sensor. $T_p$ is multiplied by $K_1$ to provide a value of A/F which is purposely made to deviate from a value of A/F determined by a value of $t_p$.

As regards the value of the basic fuel injection quantity $t_p$, it has been a usual practice to preset a fixed maximum value $t_{pmax}$ for the value of $t_p$ so as to prevent the malfunction of continuously supplying fuel from the electromagnetic fuel injection valve for some reason. An example of the fixed maximum value $t_{pmax}$ may be about 4.5 ms.

However, while the use of the conventional fixed maximum value $t_{pmax}$ may prevent the malfunction of continuously supplying fuel from occurring, since such a value is a fixed one, it can not be used to control the air-fuel ratio with changes in engine speed under a heavy engine load condition to a desired value. Another disadvantage of conventional electronically controlled fuel injection systems is that intake air pulsations occurring under a heavy engine load conditions are transmitted directly to an air flow meter, so that a measuring plate of the air flow meter is opened excessively due to its malfunction, resulting in a computation of a basic injection quantity $t_p$, which exceeds a fuel supply quantity corresponding to an actual air flow quantity, to supply an excessive quantity of fuel from the electromagnetic injection valve, thereby causing overrich trouble.

Figures 5, 6, 8:
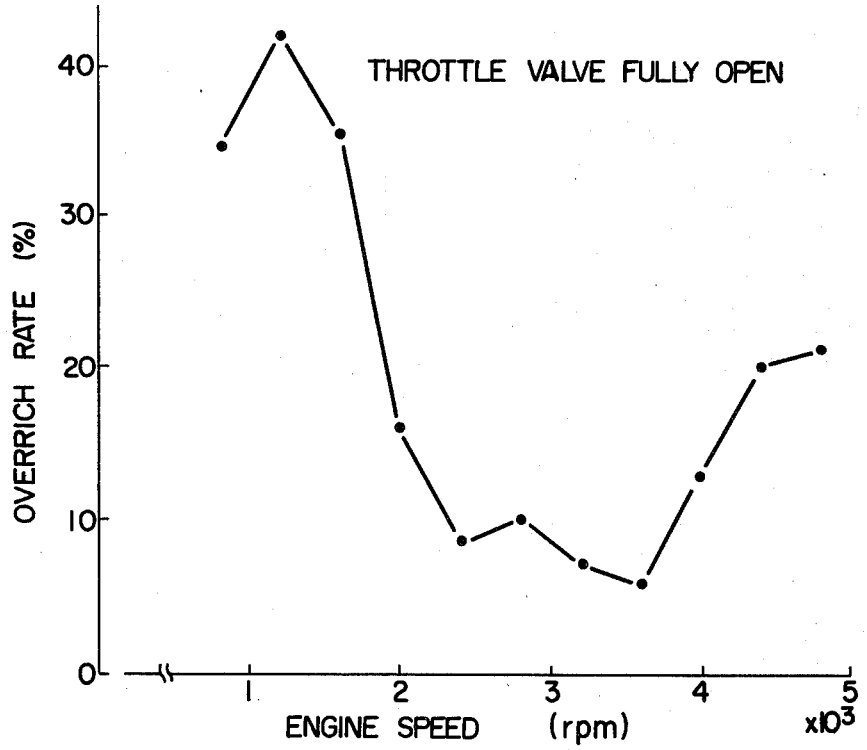
FIG. 5 is a diagram showing a table of maximum values $t_{pmax}$ of the basic fuel injection quantity $t_p$ which is useful for explaining the processing of the flow chart shown in FIG. 4.
FIGS. 6 and 7 are diagrams showing variations of the air-fuel ratio A/F which are useful for explaining the meritorious effect of the embodiment.
FIGS. 8, 9 and 10 are diagrams which are useful for explaining the other respective embodiments of the invention.

FIG. 6 shows the relation between the overrich rate and the engine speed at the fully open throttle valve position in a conventional fuel injection system.

SUMMARY OF THE INVENTION

It is an object of the present invention to provide a method and apparatus for electronic control of fuel injection which are capable of controlling the air-fuel ratio of an engine operating under heavy load conditions at a desired air-fuel ratio and simultaneously preventing the malfunction of continuously supplying fuel from the electromagnetic fuel injection valve, as done previously.

Figure 7:
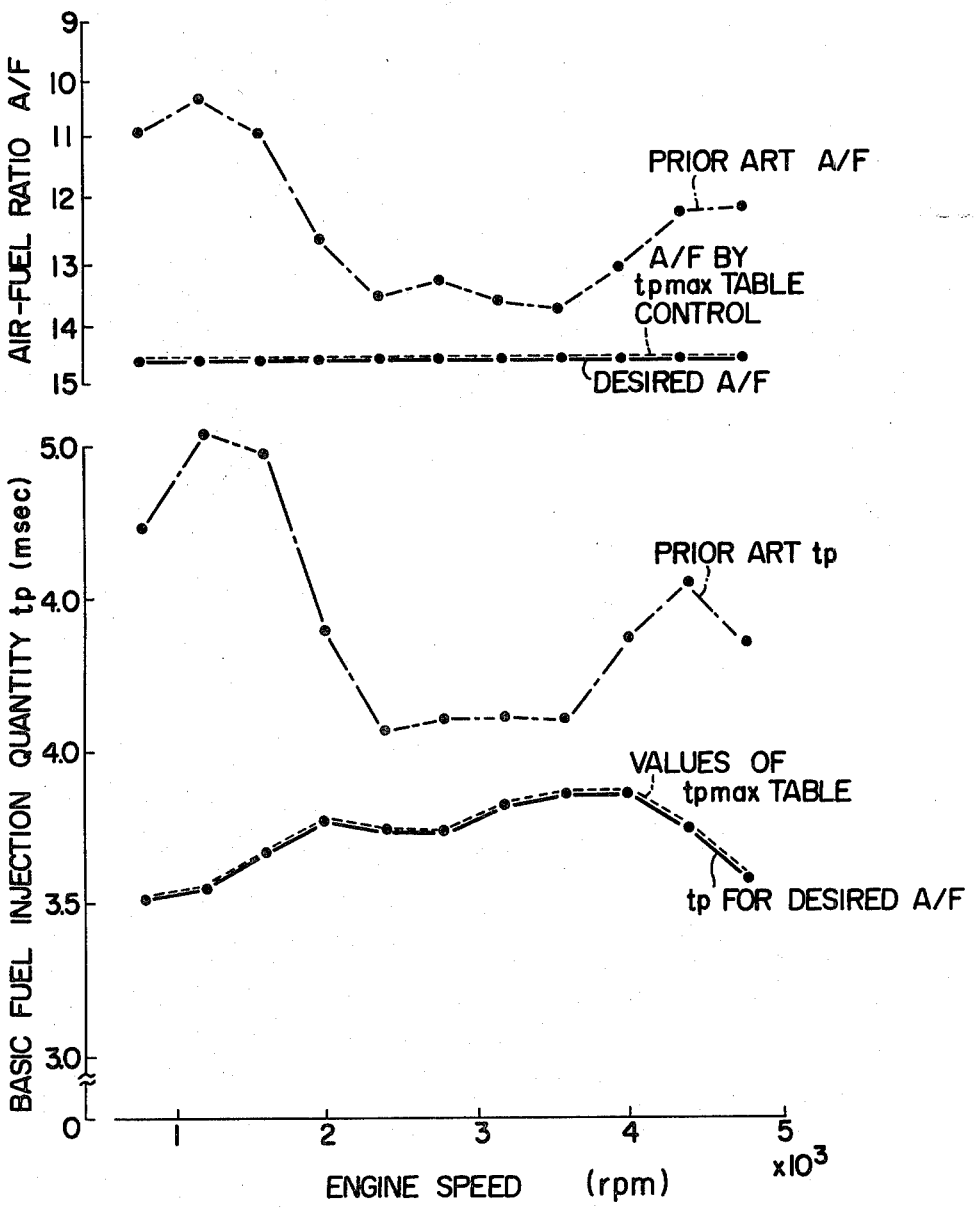

FIG. 7 shows the relation of the basic fuel injection quantity $t_p$ and the air-fuel ratio A/F versus the engine speed during heavy engine load operation with respect to cases of the prior art and the present invention, which illustrates that the air-fuel ratio can be controlled at a desired air-fuel ratio by the use of the method and apparatus of this invention which will be described hereinafter.

DESCRIPTION OF THE PREFERRED EMBODIMENTS

The present invention will now be described in greater detail with reference to the embodiments shown in the accompanying drawings.

Figure 1:
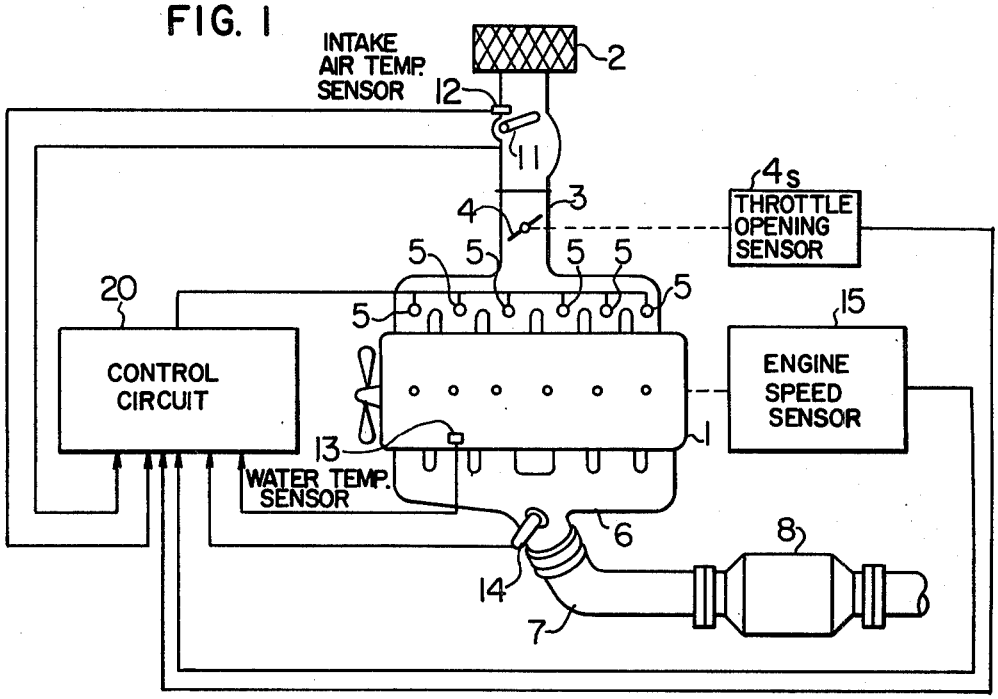
FIG. 1 is a schematic diagram showing the overall construction of the apparatus of an embodiment of the present invention.

In FIG. 1 showing the first embodiment, an engine 1 is a known type of four-cycle spark ignition engine mounted on automotive vehicles and it takes in air for combustion therein by way of an air cleaner 2, an intake pipe 3 and a throttle valve 4. A throttle opening sensor 4s for detecting an opening degree of the throttle valve 4 may be provided in case of need. Fuel is supplied from a fuel supply system (not shown) through electromagnetic fuel injectors 5 which are provided in respective engine cylinders. After each combustion exhaust gases are discharged into the atmosphere via an exhaust manifold 6, an exhaust pipe 7, a three-way catalytic converter 8, etc. The intake pipe 3 is provided with a potentiometer type air flow sensor 11 for detecting a quantity of air flow supplied to the engine 1 to generate an analog voltage corresponding to the air flow quantity and a thermistor type intake air temperature sensor 12 for detecting a temperature of intake air to generate an analog voltage. The engine 1 is provided with a water temperature sensor 13 for detecting a temperature of engine cooling water to generate an analog voltage (analog detection signal) corresponding to the cooling water temperature. There is attached to the exhaust manifold 6 an air-fuel ratio sensor 14 for detecting the air-fuel ratio from an oxygen content in the exhaust gases so that a signal voltage of about 1 volt is produced when the air-fuel ratio is smaller (rich) than a stoichiometric ratio and a signal voltage of about 0.1 volt is produced when the air-fuel ratio is greater (lean) than the stoichiometric ratio. An engine speed sensor 15 detects a rotational speed of a crankshaft of the engine 1 and produces a pulse signal having a repetition period corresponding to the rotational speed. The engine speed sensor 15 may be comprised, for example, of a ignition coil in the ignition system of the engine 1, whereby an ignition pulse signal from a primary terminal of the ignition coil may be used as an engine speed signal. A control circuit 20 computes a fuel injection quantity on the basis of detection signals from the above-described sensors 11 to 15 and a quantity of fuel injected is adjusted by controlling the opening time length of the fuel injectors 5.

Figure 2:
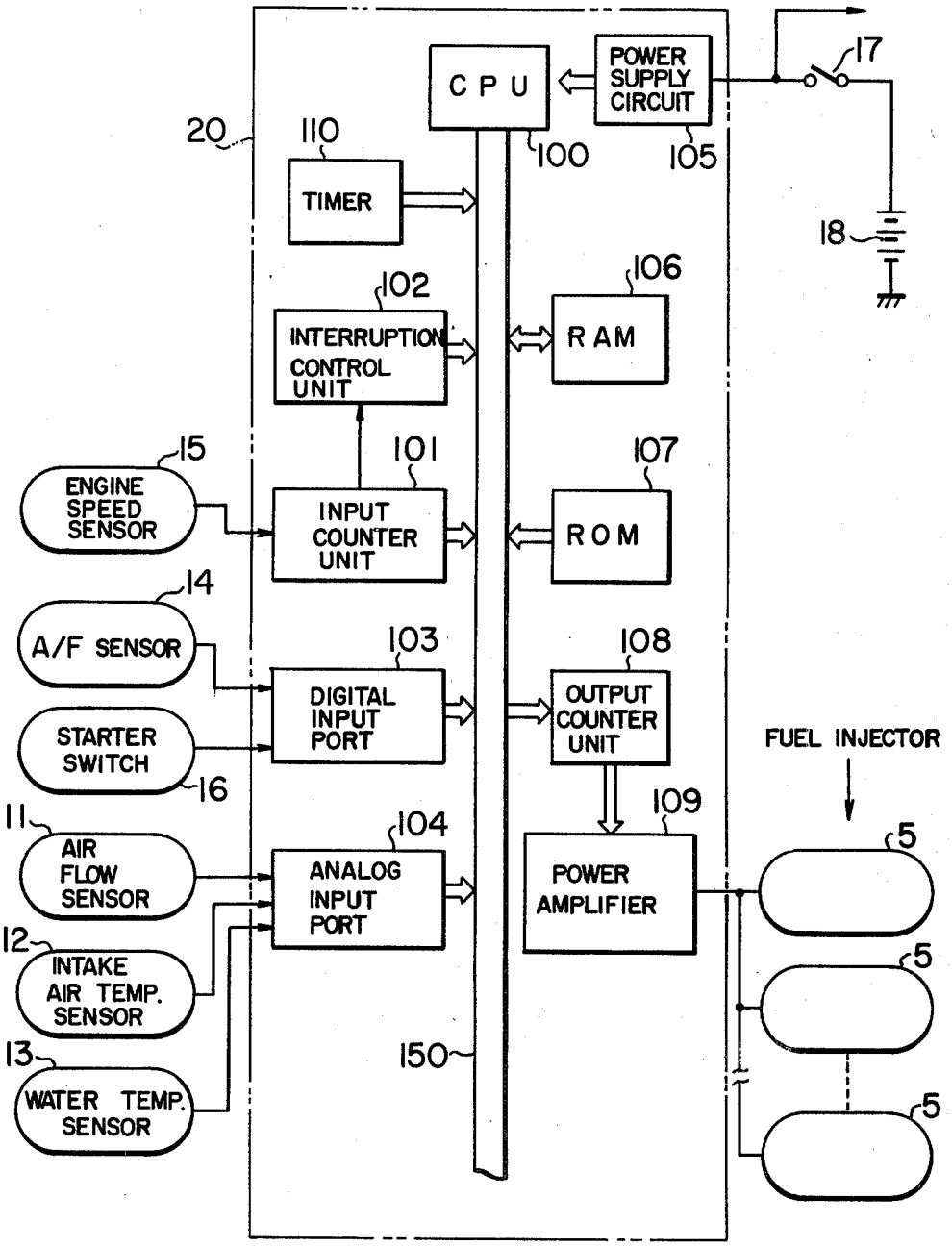
FIG. 2 is a block diagram of the control circuit 20 shown in FIG. 1.

The control circuit 20 will be described with reference to FIG. 2. Numeral 100 designates a microprocessor (CPU) for computing a fuel injection quantity. Numeral 101 designates an input counter unit responsive to the signals from the engine speed sensor 15 to measure the engine speed. Further, the input counter unit 101 operates to transmit an interruption command signal to an interruption control unit 102 in synchronism with the engine rotation. When the interruption control unit 102 receives the interruption command signal, it transmits an interruption request signal to the CPU 100 through a common bus 150. Numeral 103 designates a digital input port which transmits to the CPU 100 digital signals such as an output signal of a comparator which compares an output of the air-fuel ratio sensor 14 with a predetermined comparison level and a starter signal from a starter switch 16 which turns on and off a starter which is not shown. Numeral 104 designates an analog input port comprising an analog multiplexer and an A-D converter. The analog input port 104 has a function to subject the output signals from the air flow sensor 11, the intake air temperature sensor 12 and the water temperature sensor 13 to A-D conversion and to have the result of the A-D conversion read by the CPU 100. The output data from the units 101, 102, 103 and 104 are transmitted to the CPU 100 via the common bus 150. Numeral 105 designates a power supply circuit connected to a battery 18 through a key switch 17. Numeral 106 designates a random access memory (RAM) from which stored data are read and into which data are written. Numeral 107 designates a read-only memory (ROM) for storing programs, various constants, etc. Numeral 108 designates an output counter unit including a register and it is formed by a down counter. The counter 108 converts a digital signal indicative of an opening time length of the fuel injectors 5, namely, a fuel injection quantity computed by the CPU 100 to a pulse signal having a pulse time width which provides an actual opening time length of the fuel injectors 5. Numeral 109 designates a power amplifier for driving the fuel injectors 5. Numeral 110 designates a timer, which measures an elapsed time and transmits the result of the measurement to the CPU 100.

The input counter unit 101 is responsive to the output signal of the engine speed sensor 15 to measure the engine rotation once for every engine rotation. The counter 101 supplies an interruption command signal to the interruption control unit 102 upon completion of each measurement. In response to the interruption command signal the interruption control unit 102 generates an interruption request signal, which is supplied to the CPU 100, and causes the CPU 100 to execute an interruption processing routine for computing a fuel injection quantity.

Figure 3:
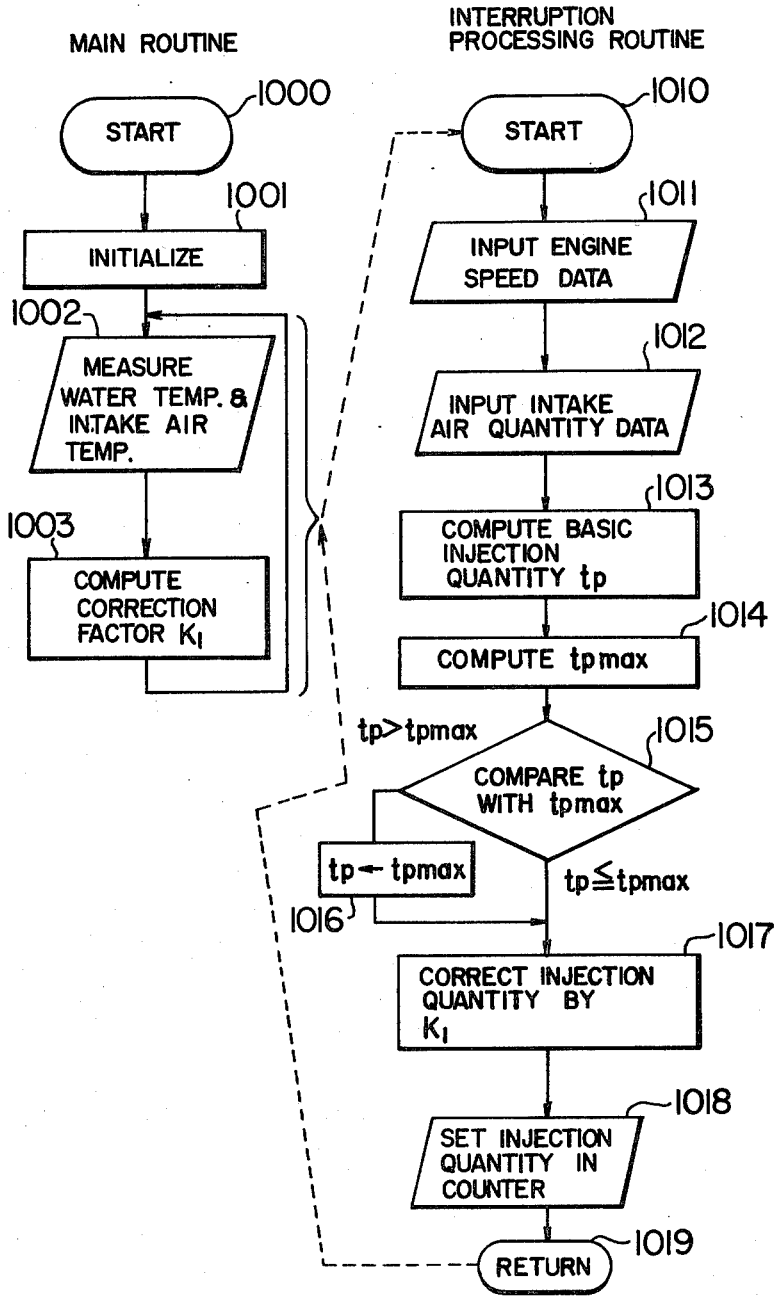
FIG. 3 is a diagram showing a simplified flow chart of the processing by the microprocessor shown in FIG. 2.
Figure 3:
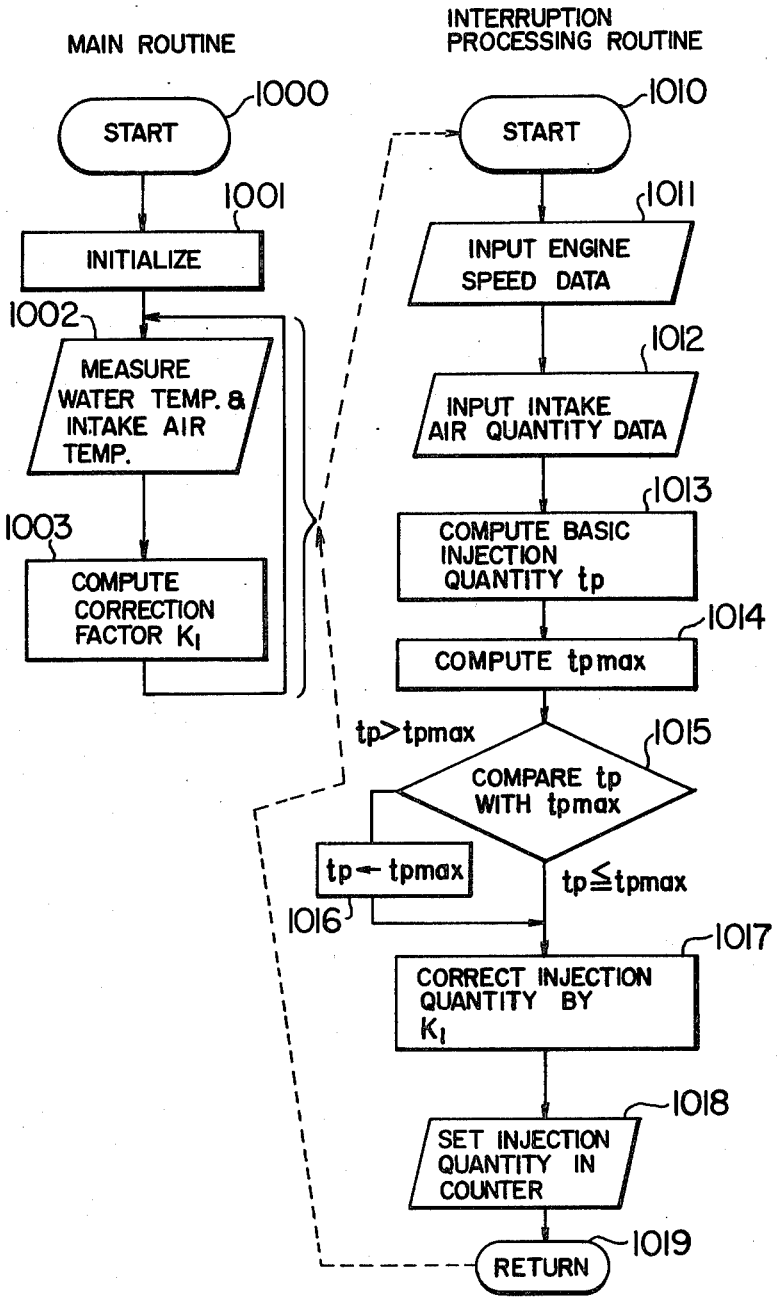

FIG. 3 shows a schematic flow chart for the CPU 100. The function of the CPU 100 as well as the operation of the whole apparatus will be described with reference to the flow chart. As the key switch 17 and the starter switch 16 are turned on to start the operation of the engine 1, the processing of a main routine is started at a step 1000, and a step 1001 effects the initialization of the processing. Then, the digital values indicative of the cooling water temperature and the intake air temperature are read through the analog input port 104 at a step 1002. A step 1003 computes a correction factor $K_1$ from the data obtained at the step 1002 and the result of the step 1003 is stored in the RAM 106. Upon completion of the operation at the step 1003, the processing returns to the step 1002.

Usually, the CPU 100 repeats the processing of the steps 1002 and 1003 in the main routine shown in FIG. 3 in accordance with a control program. Upon receipt of an interruption request signal supplied from the interruption control unit 102, even when the main routine is under execution, the CPU 100 immediately interrupts the execution of the main routine and transfers to the execution of the interruption processing routine starting from a step 1010. A step 1011 inputs a signal indicative of an engine speed N which is generated from the input counter unit 101, and then a step 1012 inputs a signal indicative of an intake air quantity Q from the analog input port 104. Then, a step 1013 computes a basic fuel injection quantity (or a basic injection time width $t_p$ of the electromagnetic fuel injection valves 5), which is determined by the engine speed N and the intake air quantity Q, and stores the result of the computation in the RAM 106. The computation is based on the equation: $t_p = F \times (Q/N)$ (where F is a constant). Then, a step 1014 computes a maximum value $t_{pmax}$ for the basic fuel injection time width $t_p$.

Figure 4:
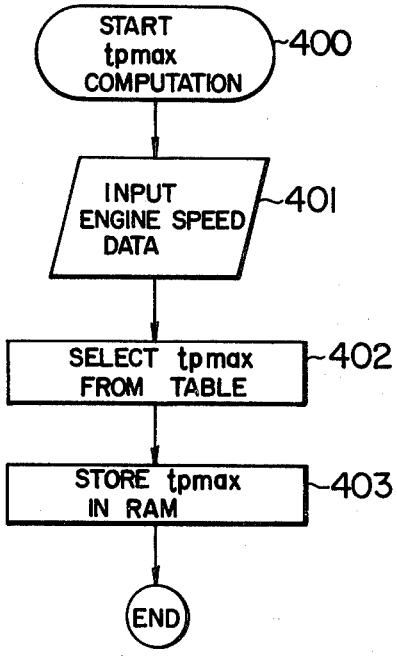
FIG. 4 is a diagram showing a detailed flow chart for a step 1014 in the flow chart shown in FIG. 3.

FIG. 4 shows a detailed flow chart for the computation of the maximum value $t_{pmax}$ at the step 1014. The computation of $t_{pmax}$ is started at a step 400. A step 401 inputs a signal indicative of the engine speed N from the input counter unit 101. In accordance with this signal, a step 402 selects a corresponding value of $t_{pmax}$ from the table of $t_{pmax}$ shown in FIG. 5 which is prearranged at or around a desired air-fuel ratio. This $t_{pmax}$ table is stored in the ROM 107. Then, the processing proceeds to a step 403 where the selected $t_{pmax}$ is stored in the RAM 106 and the computation of $t_{pmax}$ ends. It should be noted that a table of $t_{pmax}$ may be formed in combination with values of the throttle valve opening or the like in addition to values of the engine speed, as will be described later. In addition, the presetting of the values of $t_{pmax}$ may be made in any way other than the use of the $t_{pmax}$ table. Then, a step 1015 reads the values of $t_p$ and $t_{pmax}$ from the RAM 106 and compares them with each other. If $t_p > t_{pmax}$, it is decided that the result of the computation of the basic fuel injection quantity $t_p$ was wrong, and the processing transfers to a step 1016. If $t_p \leqq t_{pmax}$, it is decided that the result of the computation of the basic fuel injection quantity $t_p$ was correct and the processing proceeds to a step 1017. When the processing has transferred to the step 1016, the value of $t_{pmax}$ used in a new comparison is substituted for the value of $t_p$ so as to be used as the basic fuel injection quantity $t_p$, and then the processing prceeds to the step 1017. At the step 1017, the fuel injection correction factor $K_1$ obtained in the main routine is read from the RAM 106, and the processing is performed to correct the fuel injection quantity (the fuel injection time width) for determining an air-fuel ratio. The computation of the injection time width T is based on the equation $T = t_p \times K_1$. A step 1018 sets the corrected fuel injection quantity data in the output counter unit 108. Then the processing proceeds to a step 1019 and returns to the main routine. When the processing returns to the main routine, it returns to the processing step of the main routine which was interrupted previously for the purpose the interruption processing.

The general functions of the CPU 100 are as described above.

During a normal operation, the air flow meter functions properly, and therefore the basic fuel injection quantity $t_p$ of the electromagnetic fuel injectors 5 computed at the step 1013 is correct. Therefore, there is no need to correct the basic fuel injection quantity $t_p$. Though the step 1015 compares the value of the basic fuel injection quantity $t_p$ computed at the step 1013 with the value of $t_{pmax}$ computed at the step 1014 in FIG. 3, since the value of $t_{pmax}$ is preselected to be greater than the value of $t_p$, normally no correction is effected and the processing proceeds from the step 1015 to the step 1017.

During a heavy engine load operation, the basic fuel injection quantity $t_p$ computed by the CPU 100 at the step 1013 in accordance with the output signal of the air flow meter exceeds the value of $t_{pmax}$ corresponding to the desired air-fuel ratio, which causes the air-fuel ratio to become small (overrich). Thus, the value of $t_{pmax}$ which is predetermined in accordance with the engine speed is used as the basic fuel injection quantity $t_p$ in place of the value of $t_p$ computed by the CPU 100 thereby to control the air-fuel ratio.

By virtue of the above-described operation, it is possible to control the fuel injection quantity at proper values throughout the operating range of the engine.

While, in the above-described embodiment, only a single $t_{pmax}$ table prearranged in accordance with the engine speed is used, the control of the fuel injection quantity can be effected on the basis of two or more tables prearranged in accordance with the engine rotational speed and in additional combination with the throttle valve opening or the like. FIG. 8 shows exemplifying tables for use in such a case.

Figure 9:
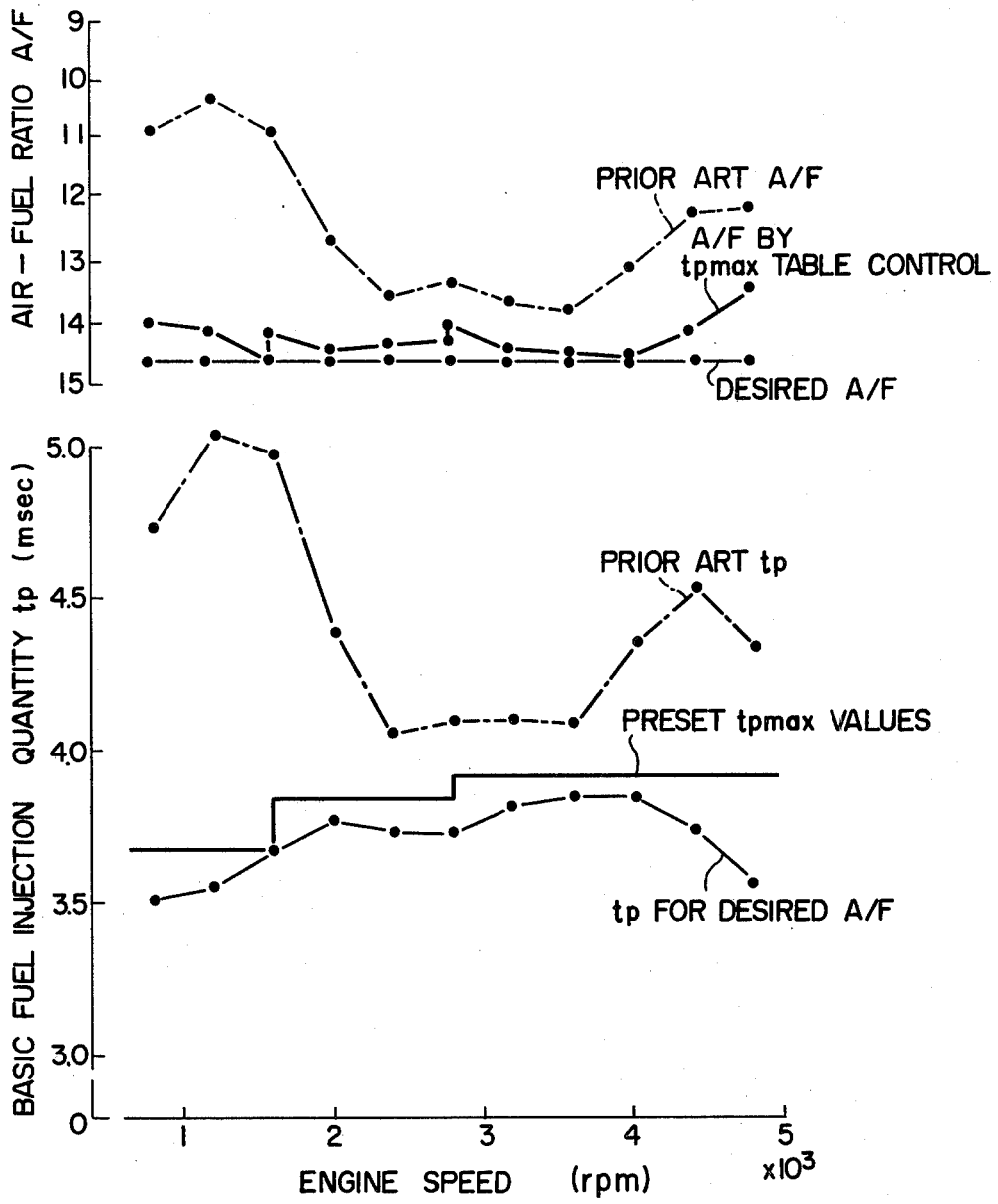

Further, as regards the above-described predetermination of $t_{pmax}$, it is possible to change the value of $t_{pmax}$ stepwise in accordance with the engine speed as shown in FIG. 9, in place of using any number of $t_{pmax}$ tables described hereinabove, and by doing so, it is possible to effect the control both in a digital mode and in an analog mode.

Figure 10:
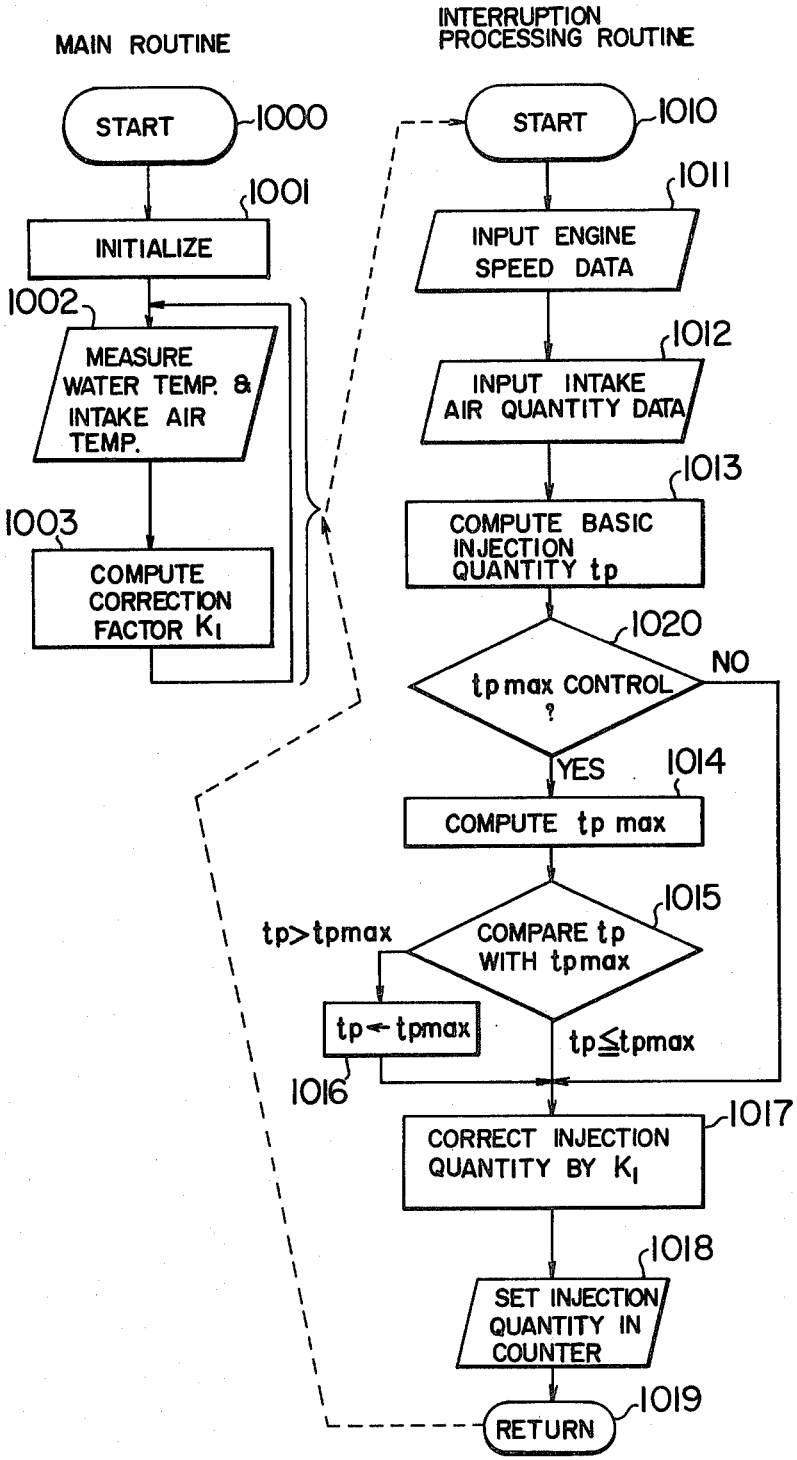

Still further, the control may be effected or eliminated, as occasion demands, depending on the values of the water temperature, the throttle opening, etc. FIG. 10 shows an exemplifying flow chart including an additional step 1020 for use in such a case. The step 1020 decides whether the temperature of engine cooling water detected by the sensor 13 is lower than a predetermined value. If the detected water temperature is lower than the predetermined value the processing bypasses the steps 1014 and 1015 and jumps to the step 1017 without effecting the control operation by the use of $t_{pmax}$.

Thus, the following remarkable meritorious effects can be obtained by the method and apparatus for electronic control of fuel injection according to this invention:

(1) A maximum fuel injection quantity $t_{pmax}$ may be selected from a $t_{pmax}$ table which is prearranged in accordance with the engine speed, thereby controlling the value of the air-fuel ratio at a desired level at various speeds of the engine operating under any heavy load conditions.

(2) Not only the $t_{pmax}$ table is prearranged in accordance with the engine speed as an engine control variable, but also a plurality of tables prearranged in accordance with the engine speed and in additional combination with the throttle valve opening may be used. In the latter case, it is possible to predetermine finer levels for the value of $t_{pmax}$.

(3) Further, instead of using such a table, the predetermination of $t_{pmax}$ may be effected in an analog way in which the value of $t_{pmax}$ is changed stepwise, for example, in accordance with the engine speed.

(4) It is possible to prevent the malfunction of continuous fuel supply from occurring in the electromagnetic fuel injection valves, while effecting the control of the fuel injection quantity simultaneously.

(5) Even if the desired air-fuel ratio is changed, the air-fuel ratio control can be accomplished by simply modifying the table of $t_{pmax}$.

(6) According to this invention, it is possible to obtain a sufficient magnitude of engine torque and a low fuel consumption rate under a heavy engine load condition.

We claim:

1. A method for electronic control of fuel injection of an internal combustion engine for controlling an air-fuel ratio of said engine having at least one fuel injector at a desired air-fuel ratio during a heavy load operation of said engine, said method comprising the steps of:

detecting operating parameters of said engine including at least engine speed and throttle valve opening;

computing by computing means a time width value of an injection pulse applied to said fuel injector;

selecting a maximum time width value of the injection pulse from a preliminarily stored table of maximum time width values thereof in accordance with said detected engine speed and throttle valve opening; and comparing said computed time width value with said selected maximum time width value and limiting said computed time width value in accordance with said selected maximum time width value.

2. A method according to claim 1, wherein said limiting step comprises the step of determining a time width of said injection pulse in accordance with said selected maximum time width value when said computed time width value is greater than said selected maximum time width value and determining a time width of said injection pulse in accordance with said computed time width value when said computed time width value is smaller than said selected maximum time width value.

3. A method for electronic control of fuel injection of an internal combustion engine for controlling an air-fuel ratio of said engine having at least one fuel injector at a desired air-fuel ratio during a heavy load operation of said engine, said method comprising the steps of:

detecting operating parameters including a cooling water temperature of said engine;

computing by computing means a time width value of an injection pulse applied to said fuel injector;

selecting a maximum time width value of the injection pulse from a preliminarily stored table of maximum time width values thereof in accordance with a detected value of at least one of said detected engine operating parameters; and comparing said computed time width value with said selected maximum time width value and limiting said computed time width value in accordance with said selected maximum time width value and limiting said computed time width value in accordance with said selected maximum time width value, wherein said selecting step and said comparing and limiting steps are eliminated when the detected cooling water temperature is lower than a predetermined value.

4. A method according to claim 3, wherein said limiting step comprises the step of determining a time width of said injection pulse in accordance with said selected maximum time width value when said computed time width value is greater than said selected maximum time width value and determining a time width of said injection pulse in accordance with said computed time width value when said computed time width value is smaller than said selected maximum time width value.

5. A method for electronic control of fuel injection of an internal combustion engine for controlling an air-fuel ratio of said engine having at least one fuel injector at a desired air-fuel ratio during a heavy load operation of said engine, said method comprising the steps of:

detecting operating parameters including an opening degree of a throttle valve of said engine;

computing by computing means a time width value of an injection pulse applied to said fuel injector;

selecting a maximum time width value of the injection pulse from a preliminarily stored table of maximum width values thereof in accordance with a detected value of at least one of said engine operating parameters; and comparing said computed time width value with said selected maximum time width value and limiting said computed time width value in accordance with said selected maximum time width value, wherein said selecting step and said comparing and limiting steps are eliminated when the detected throttle valve opening degree is smaller than a predetermined value.

6. A method according to claim 5, wherein said limiting step comprises the step of determining a time width of said injection pulse in accordance with said selected maximum time width value when said computed time width value is greater than said selected maximum time width value and determining a time width of said injection pulse in accordance with said computed time width value when said computed time width value is smaller than said selected maximum time width value.

7. An apparatus for electronic control of fuel injection of an internal combustion engine having at least one fuel injector comprising:

sensor means for detecting operating parameters of said engine including cooling water temperature; and control means responsive to an output signal of said sensor means for determining a time width value of an injection pulse applied to said fuel injector, said control means including memory means for storing maximum time width values of said injection pulse predetermined in accordance with values of at least one of said engine operating parameters, said control means selecting a maximum time width value of the injection pulse from maximum time width values thereof stored in said memory means in accordance with a detected value of at least one of said engine operating parameters and limiting said computed time width value in accordance with said selected maximum time width value, wherein the selecting and limiting operations of said control means are eliminated when the detected cooling water temperature is lower than a predetermined value.

8. An apparatus according to claim 7, wherein a time width of said injection pulse is determined in accordance with said selected maximum time width value when said computed time width value is greater than said selected maximum time width value and under any other condition the time width of said injection pulse is determined in accordance with said computed time width value.

9. An apparatus according to claim 7 or 8, wherein said sensor means includes an engine speed sensor.

10. An apparatus for electronic control of fuel injection of an internal combustion engine having at least one fuel injector comprising:

sensor means for detecting operating parameters including an opening degree of a throttle valve of said engine; and control means responsive to an output signal of said sensor means for computing a time width value of an injection pulse applied to said fuel injector, said control means including memory means for storing maximum time width values of said injection pulse predetermined in accordance with values of at least one of said engine operating parameters, said control means selecting a maximum time width value of the injection pulse from maximum time width values thereof stored in said memory means in accordance with a detected value of at least one of said engine operating parameters and limiting said computed time width value in accordance with said selected maximum time width value, wherein the selecting and limiting operations of said control means are eliminated when the detected throttle valve opening degree is smaller that a predetermined value.

11. An apparatus according to claim 10, wherein a time width of said injecton pulse is determined in accordance with said selected maximum time width value when said computed time width value is greater than said selected maximum time width value and under any other condition the time width of said injection pulse is determined in accordance with said computed time width value.

* * * * *